US009067761B2

(12) United States Patent
Ropponen et al.

(10) Patent No.: US 9,067,761 B2
(45) Date of Patent: Jun. 30, 2015

(54) ARRANGEMENT FOR DAMPING LATERAL SWAYS OF A ROPE-LIKE MEANS FIXED TO AN ELEVATOR CAR

(71) Applicants: Tuomo Ropponen, Hyvinkää (FI); Mikko Puranen, Helsinki (FI); Jarkko Saloranta, Helsinki (FI)

(72) Inventors: Tuomo Ropponen, Hyvinkää (FI); Mikko Puranen, Helsinki (FI); Jarkko Saloranta, Helsinki (FI)

(73) Assignee: KONE CORPORATION, Helsinki (FI)

( * ) Notice: Subject to any disclaimer, the term of this patent is extended or adjusted under 35 U.S.C. 154(b) by 240 days.

(21) Appl. No.: 13/626,420

(22) Filed: Sep. 25, 2012

(65) Prior Publication Data

US 2013/0020150 A1 Jan. 24, 2013

(30) Foreign Application Priority Data

Mar. 25, 2010 (FI) ..... 20100130
Mar. 22, 2011 (WO) ..... PCT/FI2011/000018

(51) Int. Cl.
*B66B 7/06* (2006.01)

(52) U.S. Cl.
CPC ..... *B66B 7/06* (2013.01)

(58) Field of Classification Search
USPC ..... 187/414, 264
See application file for complete search history.

(56) References Cited

U.S. PATENT DOCUMENTS

| | | | | | |
|---|---|---|---|---|---|
| 485,163 | A * | 11/1892 | Bassett | 187/260 |
| 741,827 | A * | 10/1903 | Potter | 187/260 |
| 1,297,713 | A * | 3/1919 | Merrill et al. | 187/263 |
| 2,537,075 | A * | 1/1951 | Margles | 187/264 |
| 3,127,957 | A * | 4/1964 | Nelson | 187/256 |
| 3,882,968 | A * | 5/1975 | Suozzo | 187/264 |
| 5,103,937 | A * | 4/1992 | Robertson | 187/414 |
| 5,861,084 | A * | 1/1999 | Barker et al. | 187/264 |
| 6,488,125 | B1 * | 12/2002 | Otsuka et al. | 187/264 |
| 7,117,978 | B2 * | 10/2006 | Kaczmarek et al. | 187/276 |
| 7,610,994 | B2 * | 11/2009 | Green | 187/251 |
| 7,762,378 | B2 * | 7/2010 | Mori et al. | 187/414 |
| 2003/0075389 | A1 * | 4/2003 | Otsuka et al. | 187/264 |
| 2004/0055831 | A1 | 3/2004 | Huber | |

FOREIGN PATENT DOCUMENTS

| | | | |
|---|---|---|---|
| CN | 1232781 | A | 10/1999 |
| JP | 50102059 | U | 8/1975 |
| JP | 55059529 | U | 4/1980 |
| JP | 1139486 | A | 5/1989 |
| JP | 1299182 | A | 12/1989 |

(Continued)

OTHER PUBLICATIONS

International Search Report PCT/ISA/210 for International Application No. PCT/FI2011/000018 dated Jun. 22, 2011.

(Continued)

*Primary Examiner* — William A Rivera
*Assistant Examiner* — Michael Riegelman
(74) *Attorney, Agent, or Firm* — Harness, Dickey & Pierce, P.L.C.

(57) ABSTRACT

The object of the invention is an arrangement for damping lateral sways of a rope-like means fixed to an elevator car in an elevator hoistway, the bottom end of which rope-like means comprises an upward opening bottom loop. A detachable damping means producing a mass effect is disposed to be supported by the top surface of the bottom loop.

16 Claims, 3 Drawing Sheets

(56) References Cited

FOREIGN PATENT DOCUMENTS

Figure 1:
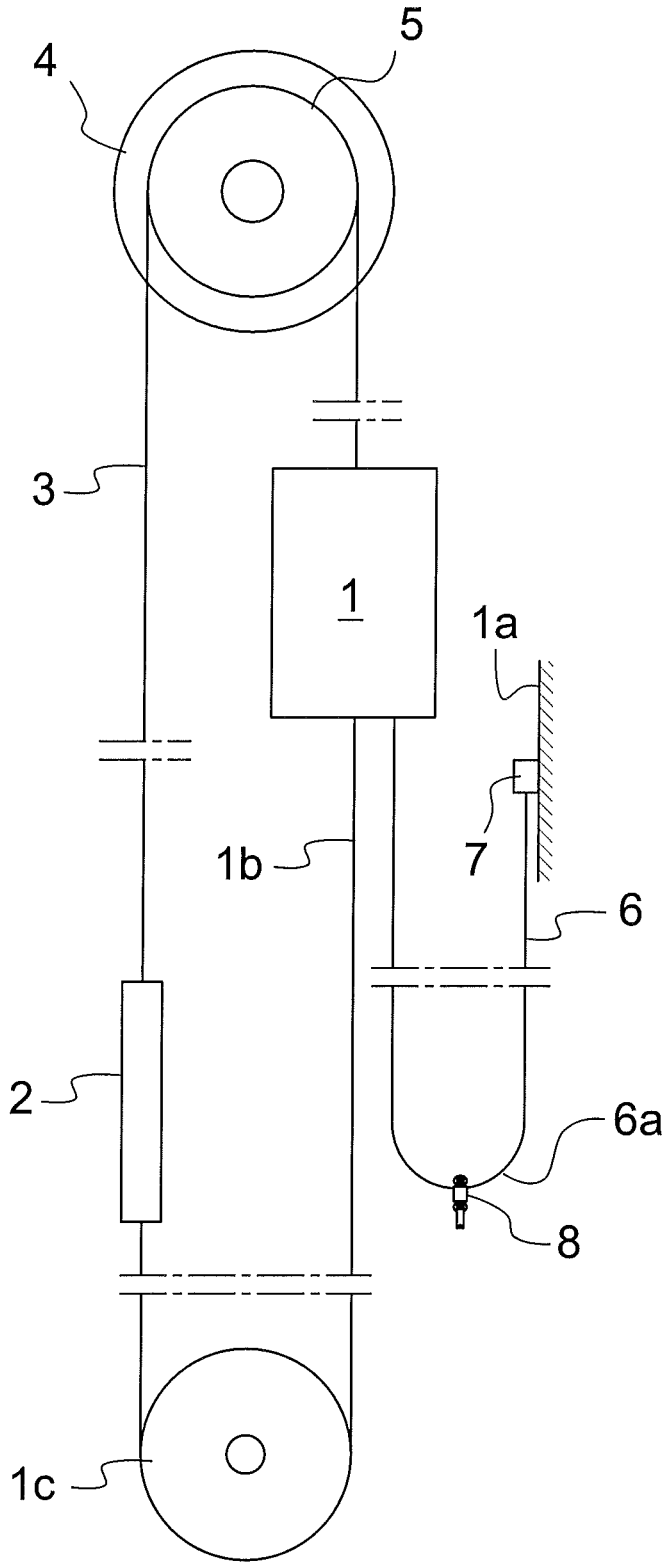

| | | | |
|---|---|---|---|
| JP | 2008183 | A | 1/1990 |
| JP | 3013478 | A | 1/1991 |
| JP | H0728166 | U | 5/1995 |
| JP | 2000086115 | A | 3/2000 |
| JP | 2007153588 | A | 6/2007 |

OTHER PUBLICATIONS

Finnish Search Report dated Jan. 18, 2011.
Chinese Office Action issued in Chinese Application No. 201180015048.4, dated Feb. 2, 2015.

* cited by examiner

ARRANGEMENT FOR DAMPING LATERAL SWAYS OF A ROPE-LIKE MEANS FIXED TO AN ELEVATOR CAR

CROSS REFERENCE TO RELATED APPLICATIONS

This is a continuation of PCT/FI2011/000018 filed Mar. 22, 2011, which is an International Application claiming priority to FI 20100130 filed on Mar. 25, 2010, the entire contents of which are hereby incorporated by reference.

The object of the invention is an arrangement for damping lateral sways of a rope-like means fixed to an elevator car in an elevator hoistway.

The rope-like means fixed to the elevator car according to the invention can be e.g. the trailing cable of an elevator, with which the necessary electrical energy is supplied to the elevator car and/or data is transmitted between the signaling devices of the elevator car, such as car call pushbuttons, communication devices and displays, and also the control system of the elevator. The rope-like means fixed to the elevator car can also be the compensating rope or compensating roping of an elevator used in high-rise buildings, in which case data and/or electricity does not necessarily travel in it.

One problem particularly in high-rise buildings and in the high-speed elevators used in them is that at high speeds vortices occur in the elevator hoistway owing to the air resistance of the elevator car, which vortices produce lateral movement in the trailing cable of the elevator and especially in the bottom loop of said cable. Sideways movement in the lateral direction of the trailing cable in high-rise buildings is also caused by movements of the elevator car itself and from swaying of the building caused mainly by wind. This type of lateral swaying is undesirable, because it increases the stressing of the trailing cable and produces noise and vibration or other discomfort to passengers of the elevator car. In addition, large lateral movement can cause the trailing cable to strike structures of the elevator hoistway, damaging hoistway devices or itself getting caught on them. In this case one consequence can even be an emergency stop of the elevator.

Various sway damping solutions are known in the art, in which the trailing cable of the elevator is normally guided with various guides to travel along a certain path.

One aforementioned prior-art controller solution is presented in the Japanese patent publication no. JP1299182(A). In it the swaying motion of the trailing cable is prevented with guide means fixed into the wall of the elevator hoistway, one above the other at a vertical distance from each other, the front edge of which guide means comprises two movable retainer arms that rotate in the opposite direction and around a horizontal axis, which retainer arms are of an L-shape that is turned upside-down. In the normal position of the retainer arms the horizontal upper parts enclose the straight part of the trailing cable that is near the wall of the elevator hoistway inside the frame part of the guide means. Correspondingly, the bottom end of the vertical bottom parts of the retainer arms comprise a weight, which keeps the retainer arms in the normal position in front of the frame part of the guide means. When the bottom loop of the trailing cable passes the guide means in either the up direction or the down direction, the bottom loop pushes the horizontal upper parts of the retainer arms, which upper parts are of opposite directions to each other, from in front of it by turning the retainer arms around the horizontal axis. A problem in this solution is at least that even a small sway of the trailing cable when the bottom loop of the cable is descending can result in the bottom loop of the trailing cable not striking inside the guide means, in which case the bottom loop remains free and also bypasses all the guide means that are lower than this guide means. After this the trailing cable will no longer funnel itself to inside the guide means. Another problem is that the trailing cable always when it is coming or going strikes the horizontal upper parts of the guide means, which mechanical contacts wear both the trailing cable and the horizontal upper parts of the retainer arms.

Another prior-art controller solution is presented in the Japanese patent publication no. JP3013478(A). In it the bottom end of the trailing cable comprises a guide device of the trailing cable fixed to be supported by a separate suspension rope, which guide device travels up and down in the elevator hoistway along with the loop of the bottom end of the trailing cable. The part of the trailing cable on the side of the wall of the elevator hoistway is disposed in a vertical channel fixed to the wall and the free end rising to the elevator car after the loop of the bottom end is prevented from swaying by the aid of a horizontal guide arm in the guide device. A problem in this solution is at least that the solution is complex and expensive. Additionally, the structure according to the solution comprises a lot of wearing parts, which can be damaged and cause, inter alia, servicing breaks, in which case the elevator must be taken out of use during the servicing or repair.

The aim of this invention is to eliminate the aforementioned drawbacks and to achieve a simple and inexpensive arrangement for damping lateral sways of a rope-like means fixed to an elevator car. In addition, one aim is to achieve an arrangement, which prevents the compensating rope and/or trailing cable from striking the hoistway structures of the elevator hoistway and also prevents the detrimental noise or damage to hoistway devices or to itself thus caused.

Some inventive embodiments are also discussed in the descriptive section of the present application. The inventive content in the application can also be defined differently than in the claims presented below. The inventive content may also consist of several separate inventions, especially if the invention is considered in the light of expressions or implicit subtasks or from the point of view of advantages or categories of advantages achieved. In this case, some of the attributes contained in the claims below may be superfluous from the point of view of separate inventive concepts. Likewise the different details presented in connection with each embodiment of the invention can also be applied in other embodiments. In addition, it can be stated that at least some of the subordinate claims can at least in some situations be deemed to be inventive in their own right.

One advantage of the arrangement according to the invention is that lateral sways of the trailing cable and/or of the compensating rope can be damped in a simple, operationally reliable and inexpensive manner. Another advantage is that as a result of the damping means according to the invention the size of the bottom loop of the trailing cable can be reduced, the added advantage of which is easier layout design. Another advantage is better ride comfort and safety, because a stable trailing cable does not catch on the hoistway structures in the elevator hoistway and therefore does not cause hazardous or damaging situations. An advantage is also the easy adjustability of the damping means. It is easy to add mass to the damping device for different situations and structural conditions, in which case the optimal damping of lateral sways in different structural solutions is easy and quick.

According to the invention, the arrangement for damping lateral sways of a rope-like means fixed to an elevator car in an elevator hoistway, the bottom end of which rope-like means comprises an upward opening bottom loop, comprises a freely hanging damping means supported on the top surface of the bottom loop.

Preferably the damping means comprises at least a roller-like means, supported by which the damping means is arranged to move freely in relation to the top surface of the bottom loop in the direction of the longitudinal axis of the rope-like means when the elevator car moves upwards and downwards.

Preferably the roller-like means is mounted on bearings that allow rotation on an essentially horizontal shaft.

Preferably, in addition to the roller-like means supported by the top surface of the bottom loop and mounted on bearings on an essentially horizontal shaft, the damping means also comprises two other roller-like means mounted on bearings on an essentially vertical shaft, one roller-like means on both sides of the rope-like means. Thus lateral support that behaves advantageously is achieved for the rope-like means. In this way the traveling and wedging of the rope-like means between a roller-like means of the damping means and the fixing means or frame parts supporting the roller-like means can be avoided.

Preferably the damping means also comprises a roller-like means below the bottom loop of the rope-like means, which roller-like means is mounted on bearings on an essentially horizontal shaft, and that all the roller-like means are fixed to each other into an essentially ring-like structure around the bottom loop by the aid of fixing means.

Preferably the width of the bottom loop of the rope-like means is essentially greater than its thickness. The damping means can therefore lean on it from above with the roller-like means such that the wide surface comprised in the bottom loop is against the ring of the roller-like means such that a contact area is formed between them, the width of which contact area is essentially greater than the thickness of the rope-like means. In this way the damping means rests in a controlled manner and without swaying problematically supported on the inner curve of the bottom loop. A separate guide arrangement is not needed for the damping means.

Preferably at least one aforementioned roller-like means, preferably all roller-like means are of a soft material at least on their surface.

Preferably the vertical distance between the roller-like means is greater than the thickness of the bottom loop of the rope-like means and the horizontal distance between the roller-like means is greater than the width of the bottom loop of the rope-like means, and that the bottom loop of the rope-like means is disposed in the vertical direction between the roller-like means and in the horizontal direction between the roller-like means.

Preferably the damping means comprises a suspension means for installing additional weights in the damping means.

Preferably the mass of the damping means with or without possible additional weights is 5-15 kg, preferably 5-10 kg, even more preferably 5-8 kg.

Preferably the aforementioned rope-like means is the trailing cable of an elevator.

Preferably the rope-like means is a compensating rope or compensating roping of an elevator.

Figure 2:
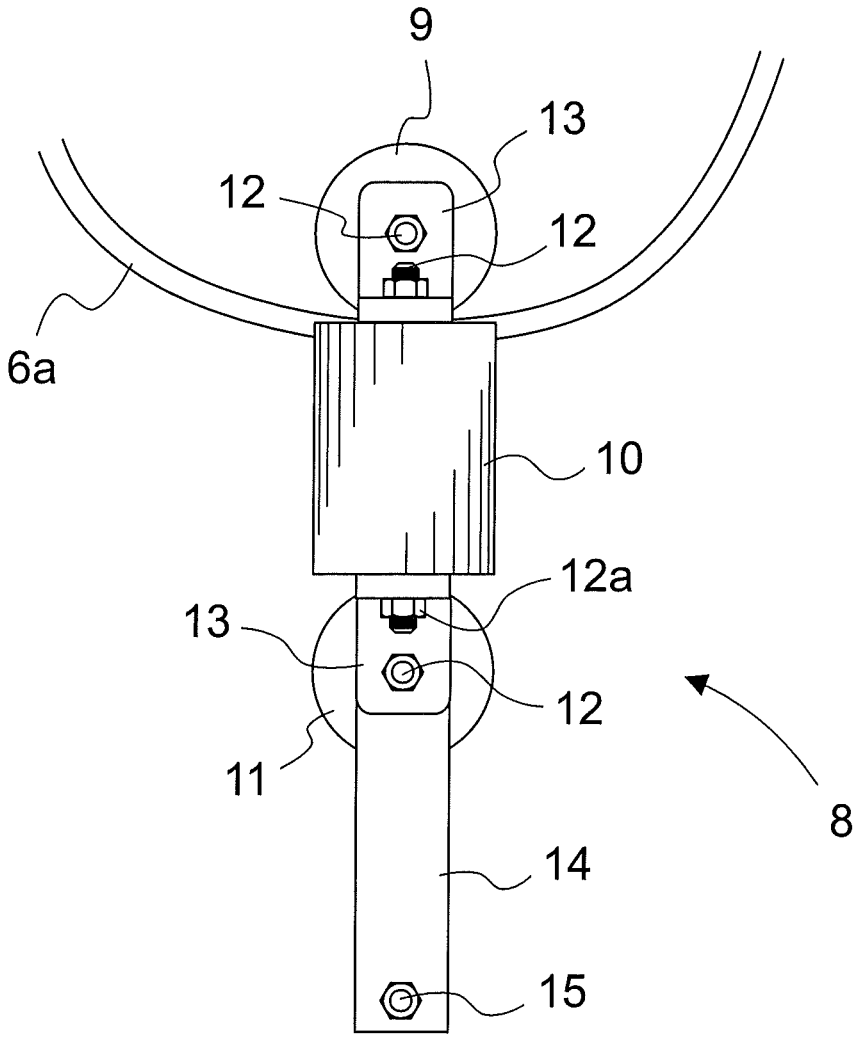
Figure 3:
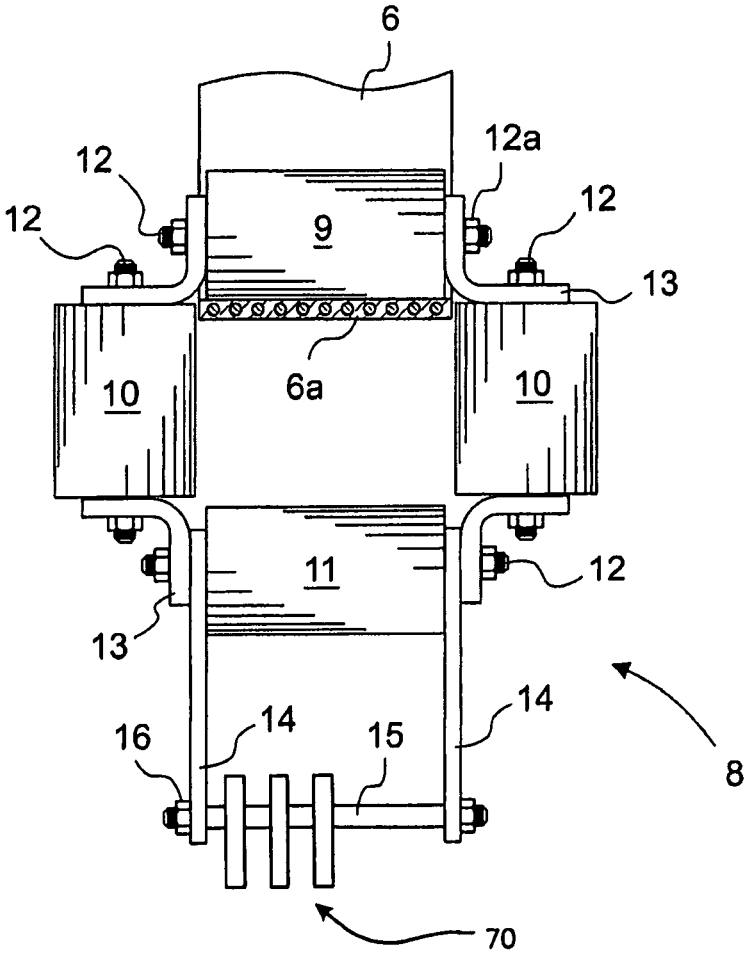

In the following the invention will be described in more detail by the aid of one example of its embodiment with reference to the attached drawings, wherein FIG. 1 presents a diagrammatic and simplified side view of one traction sheave elevator provided with a damping means according to the invention, FIG. 2 presents a magnified side view of a damping means according to the invention in its position in the bottom loop of the trailing cable, and FIG. 3 presents a magnified front view of a damping means according to the invention in its position in the bottom loop of the trailing cable.

FIG. 1 presents a simplified view of one typical traction sheave elevator, sectioned in many places in the height direction. The elevator comprises at least an elevator car 1, a counterweight 2 and, fixed between these, elevator roping formed of elevator ropes 3 that are parallel to each other. The elevator ropes 3 are guided to pass over the traction sheave 5 rotated by the hoisting machine 4 of the elevator in rope grooves dimensioned for the elevator ropes 3. As it rotates, the traction sheave 5 at the same time moves the elevator car 1 and the counterweight 2 in the up direction and down direction, due to friction. In addition, in high-rise buildings and in high-speed elevators there is a compensating rope lb, formed from one or more parallel ropes, which is fixed at its first end to the bottom end of the counterweight 2 and at its second end to the bottom part of the elevator car 1, either to the car sling or to the car itself. The compensating rope 1*b* is kept taut, e.g. by means of a compensating pulley 1*c*, under which the compensating rope 1*b* passes around and which compensating pulley 1*c* is connected to a support structure on the base of the elevator hoistway, which support structure is not, however, shown in the figure.

The trailing cable 6, e.g. flat cable of cross-sectional shape, intended for the electricity supply of the elevator car and/or for data traffic is fixed at its first end to the elevator car 1, e.g. to the bottom part of the elevator car 1, and at its second end to a connection point 7 on the wall 1*a* of the elevator hoistway, which connection point is typically at the point of the midpoint or above the midpoint of the height direction of the elevator hoistway. From the elevator car 1 the trailing cable leaves at first downwards and then turns upwards towards its fixing point 7 of the second end forming a bottom loop 6*a* in its bottom part, which bottom loop hangs freely in the elevator hoistway and moves in the hoistway upwards and downwards along with the movement of the elevator car 1. According to the invention a detachable damping means 8 is disposed in the bottom loop 6*a* of the trailing cable 6, the mass effect caused by which damping means increases the moment of inertia of the bottom loop 6*a* and thereby damps the lateral sways of the bottom loop 6*a*. The damping means 8 hangs as a free object in the bottom loop 6*a* and moves along with the bottom loop 6*a* downwards when the bottom loop 6*a* moves downwards and upwards when the bottom loop 6*a* moves upwards. In this application the attribute "hanging freely supported by the top surface of the bottom loop" means that the damping means hangs supported by the top surface, but is able to move in relation to the top surface of the bottom loop and the damping means is not supported in the lateral direction by any stationary fixed hoistway structure, such as e.g. by guide rails or by the floor or the walls of the elevator hoistway. Preferably the damping means also is not supported by other ropes of the elevator than the rope-like means, supported by which it is suspended to hang freely.

For achieving suitable damping in elevators, the mass of the damping means with or without additional weights is preferably 5-15 kg, preferably 5-10 kg, even more preferably 5-8 kg. The center of mass of the damping means is preferably fitted to be essentially below the top roller 9, preferably at least a distance from the top roller, which distance is the width (horizontal direction) of the rope-like means 6+ the thickness (vertical direction) of the rope-like means. In this way the damping means behaves advantageously, and it does not have a rotation risk. The width of the rope-like means is preferably essentially greater than its thickness. In this way it stays against the roller 9 reliably. Likewise, the swaying of the damping means in the bottom loop decreases.

FIGS. 2 and 3 present a magnified view of the damping means 8 when it is in its position in the bottom loop 6*a* of the trailing cable 6. The damping means 8 consists of a plurality of rollers 9-11 that are essentially soft at least on their surface, of which rollers there are e.g. four units, which rollers 9-11 are fixed to each other into a ring with fixing means 13 forming a right angle, by the aid of bolts 12 and nuts 12*a*. Preferably the rollers 9-11 are arranged to rotate on bolts 12 that function as shafts. The top roller 9 and the bottom roller 11 are disposed, in terms of their axis, in an essentially horizontal position and the side rollers 10 are disposed, in terms of their axis, in an essentially vertical position. The top roller 9 is fitted to travel on top of the bottom loop 6*a* of the trailing cable 6 supported by the top surface of the bottom loop 6*a* and the bottom roller 11 is correspondingly fitted to travel below the bottom loop 6*a* of the trailing cable 6 such that between the bottom surface of the bottom loop 6*a* and the top surface of the bottom roller is a vertical distance. The whole damping means 8 thus rests, freely supported by the top roller 9, on the top surface of the bottom loop 6*a*.

The horizontal distance between the side rollers 10 is greater than the width of the bottom loop 6*a* of the trailing cable 6 so that the damping means 8 would be able to move freely in relation to the bottom loop 6*a* when the bottom loop 6*a* ascends and descends. At least a part of the thickness of the bottom loop 6*a*, preferably the whole of the thickness of the bottom loop 6*a*, extends to below the top ends of the side rollers 10, in which case when the elevator car moves, the top ends of the side rollers 10 in turn strike the side surfaces of the bottom loop 6*a*.

Stem-like means 14 extending downwards are fitted to the shaft 12 of the bottom roller 11 on both sides of the ends of the bottom roller 11, which stem-like means are connected to each other with a pin-like suspension means 15 at the bottom end of the stem-like means 14, at both ends of which suspension means are threads for fixing nuts 16. The suspension means 15 is intended for placing additional weights 70 in the damping means 8 when adjusting the damping means to be suitable for the structures and conditions. The presence of a bottom roller 11 is not essential. Amongst other things, its presence facilitates servicing of the device, because it can easily be transferred, if necessary, to the place of the top roller 9.

In the arrangement according to the invention the rope-like means 6 is preferably fixed to the bottom part of the elevator car 1, either to the car sling or to the car itself, such that the fixing point is at the point of the vertical projection of the inside space of the car, from which fixing point the rope-like means 6 descends downwards in the elevator hoistway. Thus the rope-like means is not prone to colliding with the walls of the elevator hoistway.

The solution can also be utilized such that the rope-like means 6 is a compensating rope or compensating roping of an elevator. In this case the compensating rope lb presented can be unnecessary.

The rollers 9-11 are essentially soft, at least on their surface, as mentioned previously. In this case the soft surface of the rollers 9-11 does not wear the trailing cable 6 when the damping means 8 moves in relation to the trailing cable 6 on the surface of the bottom loop 6*a*. On the inside the rollers 9-11 can be e.g. of metal for achieving the mass effect needed. It is obvious to the person skilled in the art that the invention is not limited to the embodiment example presented above, but that it may vary within the scope of the claims to be presented below. Thus, for example, the elevator can just as well be implemented without compensating ropes 1*b* and compensating pulley 1*c*.

It is further obvious to the person skilled in the art that the arrangement according to the invention can also be used in elevators without a counterweight and also in hydraulic elevators. It is further obvious to the person skilled in the art that the damping means can be structurally, different to what is described above. The damping means can comprise, for example, fewer rollers than the four rollers presented above. For example, there can be only three rollers, in which case e.g. the bottom roller is omitted. It is further obvious to the person skilled in the art that the side rollers of the damping means do not necessarily need to be as high as what is presented in the figures. It is sufficient if there is suitably empty space below the bottom surface of the bottom loop of the trailing cable so that the bottom surface does not catch on the hard structures of the damping means.

The invention claimed is:

1. An arrangement for damping lateral sways of a rope or cable fixed to an elevator car in an elevator hoistway of an elevator, the arrangement comprising:

a freely hanging damper supported on a top surface of an upward opening bottom loop of the rope or cable, the freely hanging damper including, a first roller configured to rotate on a first shaft, and to enable the freely hanging damper to move freely relative to the top surface of the upward opening bottom loop in a direction of a longitudinal axis of the rope or cable when the elevator car moves upward and downward, at least two second rollers, each of the at least two second rollers being configured to rotate on a corresponding one of at least two second shafts, the at least two second rollers and corresponding second shafts being arranged at respective sides of the rope or cable, and being arranged substantially perpendicular to the first roller and the first shaft, a third roller configured to rotate on a third shaft, the third roller and third shaft being arranged opposite the first roller and the first shaft, and below the upward opening bottom loop of the rope or cable, and a pin suspension configured to hold additional weights, the pin suspension being arranged below the third roller and the upward opening bottom loop of the rope or cable.

2. The arrangement according to claim 1, wherein the first shaft substantially horizontal.

3. The arrangement according to claim 2, wherein the at least two second shafts are substantially vertical shafts.

4. The arrangement according to claim 3, wherein:

the third shaft is substantially horizontal; and the first roller, the at least two second rollers and the third roller are fixed to each other in a ring structure around the upward opening bottom loop of the rope or cable.

5. The arrangement according to claim 4, wherein at least one of the first roller, the at least two second rollers and the third roller are formed of a soft material at least on a surface.

6. The arrangement according to claim 5, wherein each of the first roller, the at least two second rollers and the third roller are formed of a soft material on at least one surface.

7. The arrangement according to claim 4, wherein:

a vertical distance between the first and third rollers is greater than a thickness of the upward opening bottom loop of the rope or cable;

a horizontal distance between the at least two second rollers is greater than a width of the upward opening bottom loop of the rope or cable;

the upward opening bottom loop of the rope or cable is arranged in the vertical direction between the first and third rollers; and the upward opening bottom loop of the rope or cable is arranged in the horizontal direction between the at least two second rollers.

8. The arrangement according to claim 1, wherein the width of the upward opening bottom loop of the rope or cable is greater than a thickness of the rope or cable.

9. The arrangement according to claim 1, wherein a mass of the freely hanging damper with or without the additional weights is between about 5 kg and about 15 kg, inclusive.

10. The arrangement according to claim 5, wherein the mass of the freely hanging damper with or without the additional weights is between about 5 kg and about 10 kg, inclusive.

11. The arrangement according to claim 10, wherein the mass of the freely hanging damper with or without the additional weights is between about 5 kg and about 8 kg, inclusive.

12. The arrangement according to claim 1, wherein the rope or cable is a trailing cable of the elevator.

13. The arrangement according to claim 1, wherein the rope or cable is a compensating rope or compensating roping of the elevator.

14. The arrangement according to claim 1, wherein the pin suspension is separate from, and in addition to, the first, second and third shafts.

15. The arrangement according to claim 14, wherein the additional weights are separate from, and in addition to, the first, second and third rollers.

16. The arrangement according to claim 1, wherein the additional weights are separate from, and in addition to, the first, second and third rollers.

* * * * *